US011208242B2

(12) United States Patent
Klatt

(10) Patent No.: US 11,208,242 B2
(45) Date of Patent: Dec. 28, 2021

(54) BUNG PLUG CLOSURE

(71) Applicant: Schuetz GmbH & Co. KGaA, Selters (DE)

(72) Inventor: Bernd Klatt, Ruppach-Goldhausen (DE)

(73) Assignee: Schuetz GmbH & Co. KGaA, Selters (DE)

( * ) Notice: Subject to any disclaimer, the term of this patent is extended or adjusted under 35 U.S.C. 154(b) by 422 days.

(21) Appl. No.: 16/461,405

(22) PCT Filed: Nov. 16, 2017

(86) PCT No.: PCT/EP2017/079448
§ 371 (c)(1),
(2) Date: May 16, 2019

(87) PCT Pub. No.: WO2018/108435
PCT Pub. Date: Jun. 21, 2018

(65) Prior Publication Data

US 2019/0344942 A1 Nov. 14, 2019

(30) Foreign Application Priority Data

Dec. 12, 2016 (DE) ..... 10 2016 124 071.0

(51) Int. Cl.
*B65D 51/20* (2006.01)
*B65D 39/08* (2006.01)
(Continued)

(52) U.S. Cl.
CPC ..... *B65D 51/20* (2013.01); *B65D 39/088* (2013.01); *B65D 39/086* (2013.01); *B65D 41/58* (2013.01); *B65D 55/06* (2013.01); *B65D 2401/15* (2020.05)

(58) Field of Classification Search
CPC ..... B65D 39/088; B65D 51/20
(Continued)

(56) References Cited

U.S. PATENT DOCUMENTS 8,727,175 B2 * 5/2014 Schutz ..... B65D 45/345 220/601
9,527,631 B2 * 12/2016 Grittmann ..... B67D 1/125
(Continued)

FOREIGN PATENT DOCUMENTS

CL 199700826 3/1998
CL 201101421 1/2012
(Continued)

*Primary Examiner* — J. Gregory Pickett
*Assistant Examiner* — Tia Cox
(74) *Attorney, Agent, or Firm* — Dickinson Wright PLLC; Andrew D. Dorisio

(57) ABSTRACT

A bung plug closure (30) for fastening a plug depression formed in a bung plug (31), said plug depression comprising a receiving area for receiving a resilient engagement body realized on the seal cap (11), and said bung plug (31) comprising tool engagement projections (33), which are arranged on an inner wall of the plug depression and which are distanced to each other via gaps (34) and which delimit the receiving space using inner surfaces (37), counter-locking elements (32) being provided in the plug depression, said counter-locking elements (32) being arranged in the area of the gaps (34) above an annular frame (35, 61), which is formed outside of the gaps (34) via lower sections (36) of the inner surfaces (37).

9 Claims, 4 Drawing Sheets

(51) Int. Cl.
*B65D 41/58* (2006.01)
*B65D 55/06* (2006.01)

(58) Field of Classification Search
USPC ..... 220/258.3
See application file for complete search history.

(56) References Cited

U.S. PATENT DOCUMENTS

| | | | | |
|---|---|---|---|---|
| 2005/0082076 | A1* | 4/2005 | Przytulla | B65D 1/12 174/50 |
| 2010/0000998 | A1* | 1/2010 | Schutz | B65D 39/082 220/288 |
| 2010/0282705 | A1* | 11/2010 | Ledemeney | B65D 39/08 215/251 |
| 2010/0282751 | A1* | 11/2010 | Quirijnen | B65D 51/1644 220/303 |
| 2010/0301046 | A1* | 12/2010 | Schuetz | B65D 41/48 220/259.4 |
| 2016/0297582 | A1* | 10/2016 | Julien | B65D 41/17 |
| 2017/0152077 | A1* | 6/2017 | Schuetz | B65D 55/0863 |

FOREIGN PATENT DOCUMENTS

| | | | |
|---|---|---|---|
| DE | 102009022800 | B3 | 8/2010 |
| DE | 202015008143 | U1 | 12/2015 |
| EP | 2144821 | A1 | 1/2010 |

* cited by examiner

Fig. 1
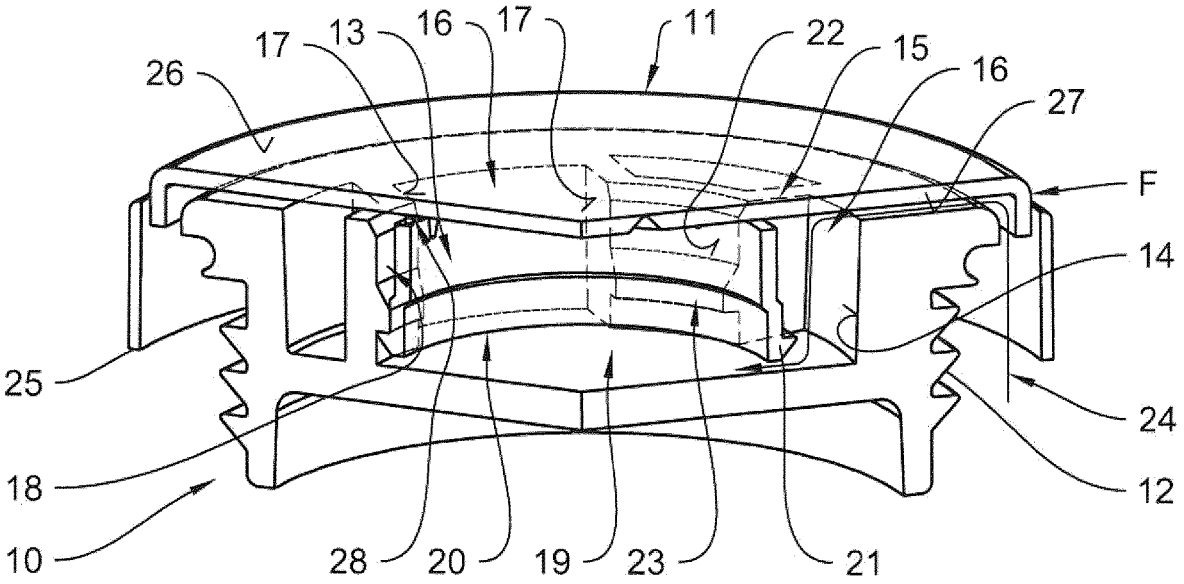
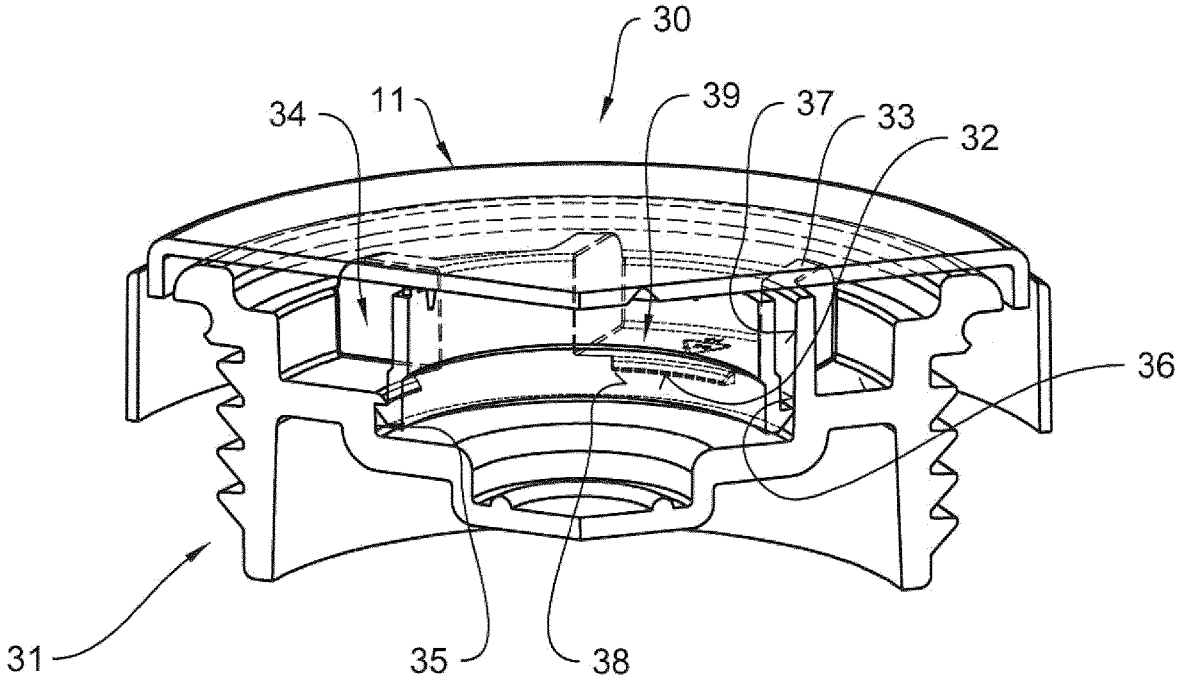
Fig. 2

BUNG PLUG CLOSURE

FIELD OF THE INVENTION

The invention at hand relates to a bung plug closure for a bung container having a bung plug for being arranged in a bung neck of the bung container and having a seal cap for sealing a plug depression formed in the bung plug, said plug depression comprising a receiving area for receiving a resilient engagement body formed on the seal cap, and said bung plug comprising tool engagement projections, which are arranged at an inner wall of the plug depression and which are distanced to each other via gaps and which delimit the receiving area using inner surfaces which at least in sections form guide surfaces for axially guiding an annular locking protrusion of the engagement body when inserting the engagement body into the plug depression, counter-locking elements for locking the annular locking protrusion of the engagement body to the bung plug being provided in the plug depression, said counter-locking elements radially protruding over the annular locking protrusion of the engagement body after locking.

BACKGROUND OF THE INVENTION

A plug closure of the make mentioned above is known from EP 2 144 821 B1. In order to lock the annular locking protrusion of the engagement body to the bung plug, counter-locking elements formed on the tool engagement projections of the bung plug on the inner surface are provided, said counter-locking elements protruding radially inward over the annular locking protrusion of the engagement body after locking. In the area of the gaps formed between the tool engagement projections, the annular locking protrusion of the engagement body protrudes into an engagement area accessible from the top so that it becomes possible for a suitably formed manipulation tool to engage under a seal cap arranged on the bung plug and to deform the annular locking protrusion of the engagement body radially inward in the area of the gaps so as to detach the annular locking protrusion from the resilient engagement with the counter-locking element formed on the inner surface of the tool engagement projections and to remove the seal cap from the bung plug without damaging a predetermined breaking device formed in a cap lid.

Thus, manipulating a bung plug becomes possible without being externally recognizable on the seal cap so that the desired security against manipulation is not attained through the seal cap.

SUMMARY OF THE INVENTION

The object of the invention at hand is therefore to propose a bung plug closure having an increased security against manipulation.

In order to attain this object, the bung plug closure according to the invention comprises the features of claim 1.

According to the invention, the counter-locking elements are arranged in the area of the gaps above an annular frame, which are formed outside of the gaps via lower sections of the inner surfaces of the tool engagement projections, in such a manner that the annular locking protrusion is received by the annular frame.

According to the invention, the embodiment of the bung plug having counter-locking elements in the area of the gaps above an annular frame receiving the annular locking protrusion impedes accessing the locking protrusion of the engagement body in the area of the gaps. Furthermore, the frame annularly surrounding the annular locking protrusion of the engagement body forms a deformation obstacle in particular in the area of the gaps since the locking protrusion supports itself at least in sections on the frame when a force radially acts on the locking protrusion so that even when destroying the counter-locking element in the area of the gaps in consequence to applying a tool under a manipulation attempt, deforming the annular locking protrusion is made significantly more difficult.

This advantageous effect does not presume that the frame is formed continuously in all instances but rather also ensues when a frame is formed between the gaps at least in sections so that deforming the annular locking protrusion is impeded in each instance under manipulation. This effect thus is also effective when areas are formed in the frame at least in sections. Therefore, the effect also ensues when spaces are formed in section in the frame. Furthermore, it is not required for the advantageous effect of the annular frame to comprise a consistent diameter for receiving the locking protrusion of the engagement body. As long as the effect impeding deformations of the engagement body are achieved, the frame can also comprise segments which protrude into or recede from the receiving area.

Similar to the annular locking protrusion of the engagement body, the annular frame can be made up in particular of segments, which are arranged annularly, upon keeping the general ring shape.

How large possible spaces of the frame formed in the area of the gaps can be without significantly limiting the effect of the frame impeding deformations depends on the non-deformability of the annular locking protrusion of the engagement body, amongst other things.

Preferably, the annular frame is delimited downward by a peripheral edge of a depression bottom of the plug depression so that not only radially deforming the annular locking protrusion of the engagement body is made more difficult via the frame but engaging the annular locking protrusion from underneath is also further impeded, in particular when the annular locking protrusion rests against the peripheral edge of the depression bottom.

Preferably, the peripheral edge of the depression bottom is elevated for forming a bottom indentation with respect to a bottom floor so that the plug depression extends downward over the peripheral edge, and the bottom indentation formed in the bung plug forms an enlarged engagement area or guide area for a bung plug key, which serves for removing the bung plug after removing the seal cap, in order to receive a guide pin of the bung plug key for example.

In a particular embodiment, the annular frame is delimited upward in the area of the gaps via platform surfaces, which extend radially outward, in such a manner that the annular frame is formed in the area of the gaps via front surfaces of supporting platforms formed in the gaps. In this context, the supporting platforms ensure a particular rigidity of the frame in the area of the gaps.

A particularly rigid embodiment of the supporting platforms becomes possible when the platform surfaces of the supporting platforms formed in the area of the gaps are formed via a supporting collar which extends radially inward and is formed on an inner wall of the bung plug.

In another particularly preferred embodiment, the annular frame is formed in the area of the gaps via webs connecting the tool engagement projections to each other, material recesses being provided between the webs and the inner wall of the plug depression so that an effective deformation obstacle is formed in the area of the gaps via the webs while simultaneously minimizing the use of material for forming the deformation obstacle.

If webs which protrude radially inward from the inner wall of the plug depression are formed in the gaps, the webs form insertion obstacles when trying to insert a manipulation tool into the gaps from the top. Furthermore, it can be achieved by centrally arranging the bung plug key in the plug depression that a key torque can be ideally transferred unto the tool engagement projections of the bung plug in order to facilitate twisting the bung plug in our out.

If, in the area of the gaps, the bung plug comprises a plug cross section sloping radially inward starting from the counter-locking element towards the frame, the peripheral edge of the depression bottom and a sleeve-shaped shoulder, which is formed in the transition to the bottom floor, in a step-like manner, a substantial inherent stability of the bung plug is enabled requiring minimal use of material for producing the bung plug in a forming process, e.g. injection molding.

If the tool engagement projections of the bung plug comprise an edge elevation at the upper edge of the inner surfaces in such a manner that an indentation is formed between the edge elevation and an upper peripheral edge of the inner wall of the plug depression, another insertion obstacle is formed via the elevated edge web, on the one hand, when attempting to insert a manipulation tool into the plug depression and on the other hand the indentation enables receiving a lower edge of a second bung plug arranged on a first bung plug so that a stacking aid is formed which enables a defined stacking arrangement for a plurality of bung plugs for facilitating storing the bung plugs when automatically supplying the bung plugs to a bung neck for a subsequent automatic screwing.

BRIEF DESCRIPTION OF THE DRAWING FIGURES

In the following, preferred embodiments of the bung plug closure are further described by way of the drawing.

In the drawing,

FIG. 1 shows a bung plug closure according to the state of the art in an isometric partial section;

FIG. 2 shows an embodiment of a bung plug closure according to the invention in an isometric partial section having a bung plug in a first embodiment;

DETAILED DESCRIPTION OF THE INVENTION

Figure 3:
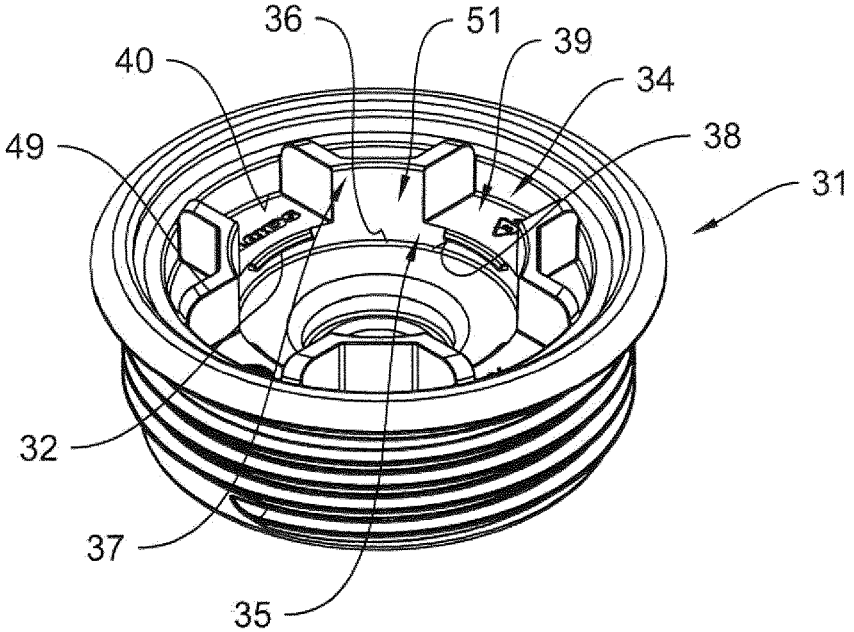
FIG. 3 shows the bung plug shown in FIG. 2 on its own.

FIG. 1 shows a bung plug closure according to the state of the art having a seal cap 11 arranged on a bung plug 10. The bung plug 10 is provided with an external thread 12 for being screwed into a bung neck not further illustrated here. The bung plug 10 comprises a plug depression 13 having tool engagement projections 15 which are formed at an inner wall 14 of the plug depression 13 and which are distanced to each other via gaps 16. The gaps 16 are delimited in a peripheral direction of the bung plug 10 via drive surfaces 17 which serve for contacting radial drives of a bung plug key inserted into the plug depression 13 and not further illustrated here in order to transfer a key torque unto the bung plug 10 upon twisting the bung plug 10 in or out.

Furthermore, as can be seen in FIG. 1, the tool engagement projections 15 delimit a receiving area 19, which is formed within the plug depression 13, using concave inner surfaces 18 for receiving an engagement body 20, which is arranged on the seal cap 11 and which is provided with an annular locking protrusion 21 on its lower end. For locking the annular locking protrusion 21 to the bung plug 10, the bung plug 10 according to the state of the art comprises counter-locking elements 23 on the inner surfaces 18 below a guide surface 22, which serves for axially guiding the annular locking protrusion 21 when inserting the engagement body 20 into the plug depression 13. As FIG. 1 clearly shows, the counter-locking elements 23 protrude radially inward over the annular locking protrusion 21 after locking with the annular locking protrusion 21 of the engagement body 20 so that the lock counteracts a removal of the seal cap 11 from the bung plug 10.

As can be seen from the sectional view according to FIG. 1, the embodiment of the bung plug 10 shown in FIG. 1 enables radially supporting or contacting the annular locking protrusion 21 of the engagement body 20 merely at the inner surfaces 18 of the tool engagement projections 15 below the counter-locking elements 23 whereas the annular locking protrusion 21 is not supported in the area of the gaps 16 and is furthermore freely accessible from radially outward, as is illustrated by an access path 24 indicated by dashed lines in FIG. 1.

Via the access path 24, a suitably formed manipulation tool can thus engage under a lower edge 25 of the seal cap 11 and can be inserted into the gaps 16 between a cap bottom 26 and a peripheral edge 27 of the bung plug 10 and can be pressed radially inward against the annular locking protrusion 21 of the engagement body 20 for deforming said annular locking protrusion 21 so that the lock between the engagement body 20 of the seal cap 11 and the bung plug 10 can be canceled out at least in a peripheral section and that the seal cap 11 can be subsequently removed from the bung plug 10 without a predetermined breaking device 28 being damaged, which is to indicate damage upon manipulation and which is formed in the cap bottom 26 in a connecting area between the cap bottom 26 and the engagement body 20.

A compressive force F acting radially outward unto the cap bottom 26 and in the plane of the cap bottom 26 can even suffice under certain circumstances in order to sufficiently disable the lock between the annular locking protrusion 21 and the counter-locking elements 23 since the gaps 16 form evasive areas into which the annular locking protrusion 21 can be deformed.

FIG. 2 shows an embodiment of a bung plug closure 30 according to the invention which differs to the bung plug closure according to the state of the art shown in FIG. 1 by a deviating embodiment of a bung plug 31. The bung plug 31 is illustrated on its own in FIGS. 3 to 5.

Figure 4:
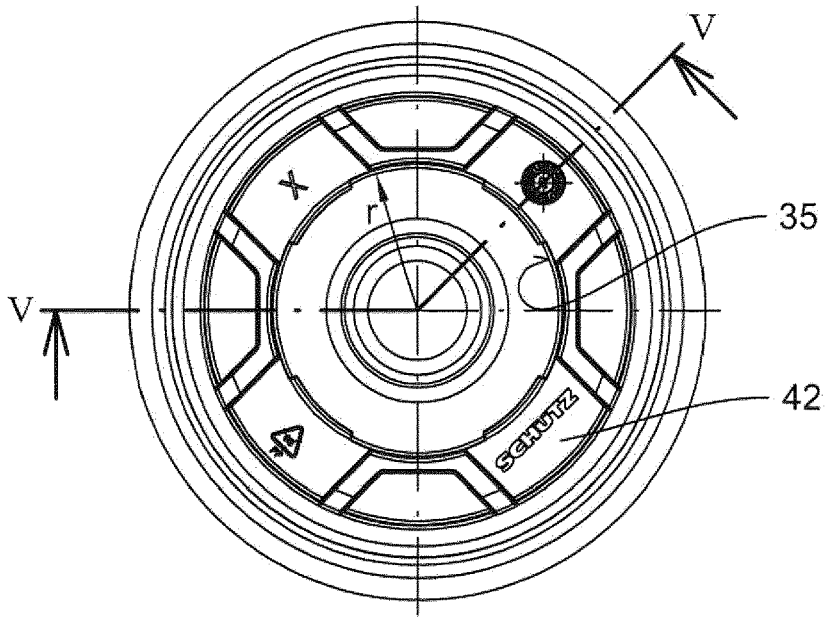
FIG. 4 shows a top view of the bung plug shown in FIG. 3.
Figure 5:
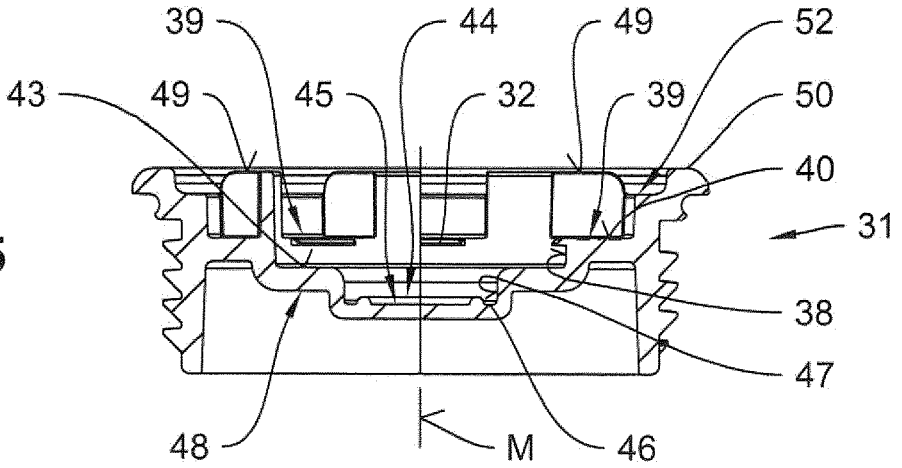
FIG. 5 shows a cross-sectional view of the bung plug shown in FIG. 3 according to cutting line V-V in FIG. 4.

As is made clear in particular by a synopsis of FIGS. 3 to 5, the bung plug 31 comprises counter-locking elements 32.

The counter-locking elements 32 are arranged above an annular frame 35 which is formed by lower sections 35 of inner surfaces 37 of tool engagement projections 33 outside of gaps 34 separating the tool engagement projections 33, said inner surfaces 37 preferably being formed in a concave manner. The frame 35 therefore comprises the sections 36 of the inner surfaces 37 as well as further sections in the area of the gaps 34 which, in the case of the embodiment of the bung plug 31 shown in FIGS. 3 to 5, are formed by front surfaces 38 of supporting platforms 39 formed by the gaps 34. As can be seen in particular in FIGS. 4 and 5, the frame 35 is formed as a continuously peripheral cylinder jacket surface having a consistent radius of curvature r based on a middle axis M of the bung plug 31 in the case of the shown embodiment.

As FIG. 2 shows, a deformation obstacle is attained due to the annular frame 35 formed by the lower sections 36 of the inner surfaces 37 and the front surfaces 38 of the supporting platforms 39 in the present case, said deformation obstacle counteracting a deformation of an annular locking protrusion 21 acting radially outward. Furthermore, the arrangement of the counter-locking elements 32 in the gaps 34 formed between the tool engagement projections 33 prevents the annular locking protrusion 21 of the engagement body 20 of the seal cap 11 from being manipulatively accessed via the gaps 34.

As a synopsis of FIGS. 3 and 5 shows, the annular frame 35 is delimited upward in the area of the gaps 34 via platform surfaces 40, which extend radially outward and which form a supporting collar 42 extending radially inward and being formed on an inner wall 42 of the bung plug 31 in sections (FIG. 4).

The annular frame 35 is delimited downward via a peripheral edge 43 of a depression bottom 44, said peripheral edge 43 being elevated for forming a bottom indentation 45 with respect to a bottom floor 46. As can be seen in particular in FIG. 5, the bung plug 31 comprises, in the area of the gaps 34, a plug cross section 48 sloping radially inward starting from the counter-locking element 32 towards the frame 35, the peripheral edge 43 of the depression bottom 44 and a sleeve-shaped shoulder, which is formed in the transition to the bottom floor 46, in a step-like manner.

As can be further seen in a synopsis of FIGS. 3 and 5, the tool engagement projections 33 comprise a peripheral elevation 49 on the upper edge of the also preferably concave inner surfaces 37 in such a manner that an indentation 52 is formed between the edge elevation 49 and an upper peripheral edge 50 of a plug depression 51 of the bung plug 31.

Figure 6:
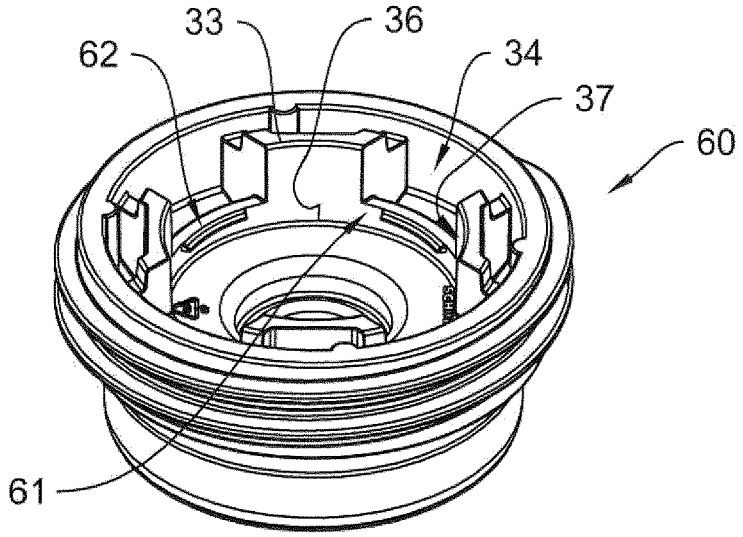
FIG. 6 shows a bung plug according to another embodiment.
Figure 7:
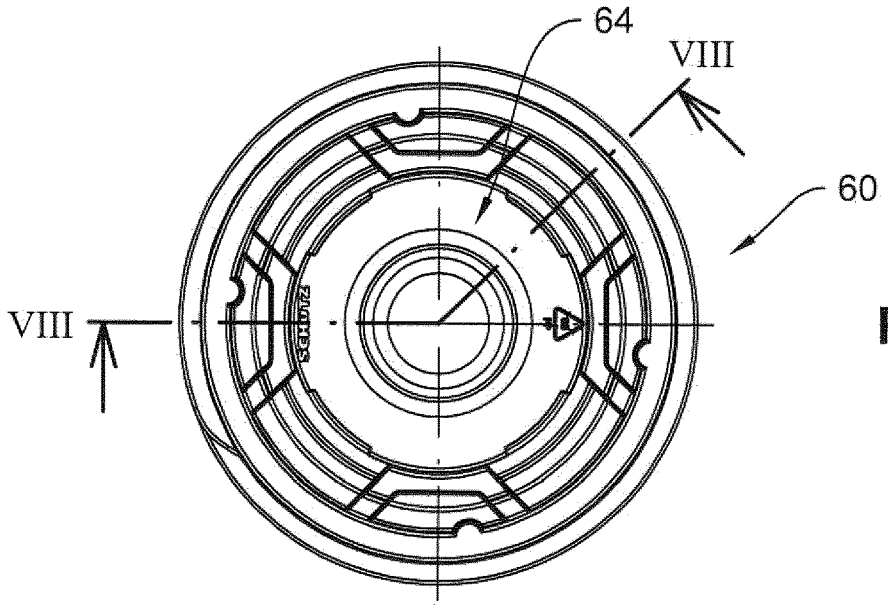
FIG. 7 shows a top view of the bung plug shown in FIG. 6.
Figure 8:
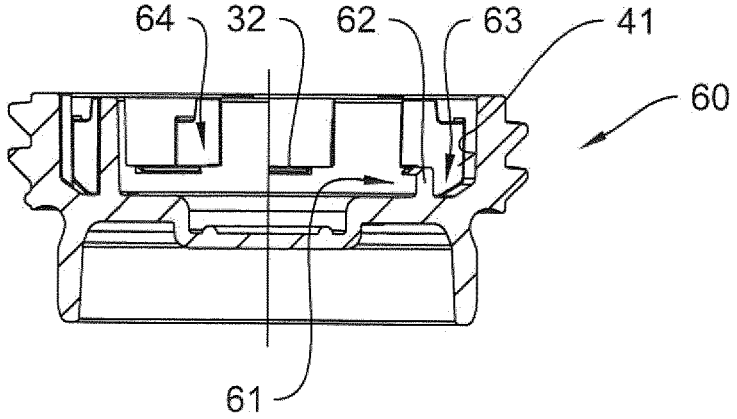
FIG. 8 shows a cross-sectional view of the bung plug shown in FIG. 6 according to cutting line VIII-VIII in FIG. 7.

In FIGS. 6 to 8, a bung plug 60 is shown in another embodiment which can be combined with the seal cap 11 shown in FIG. 2 in the same manner as the bung plug 31 described above by means of FIGS. 2 to 5 for forming a bung plug closure 30. In a generally conforming embodiment and thus with components of the bung plug 60 having identical reference numbers due to essentially identical features, the bung plug 60 comprises a frame 61 deviating from the frame 35 of the bung plug 31, said frame 61 comprising webs 62 connecting the tool engagement projections 33 in the area of the gaps 34 to each other, material recesses 63 being provided between the webs 62 and the inner wall 41 of a plug depression 64. The frame 61 is therefore made up of the sections 36 of the inner surfaces 37 of the tool engagement projections 33 and the webs 62 formed between the tool engagement projections 33, the counter-locking elements 32 being formed on the upper edge of the webs 62.

Figure 9:
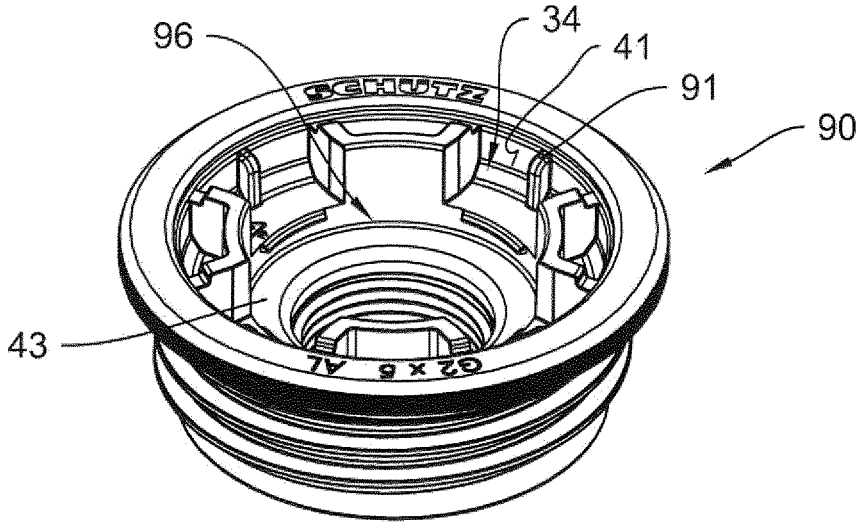
FIG. 9 shows another embodiment of a bung plug.
Figure 10:
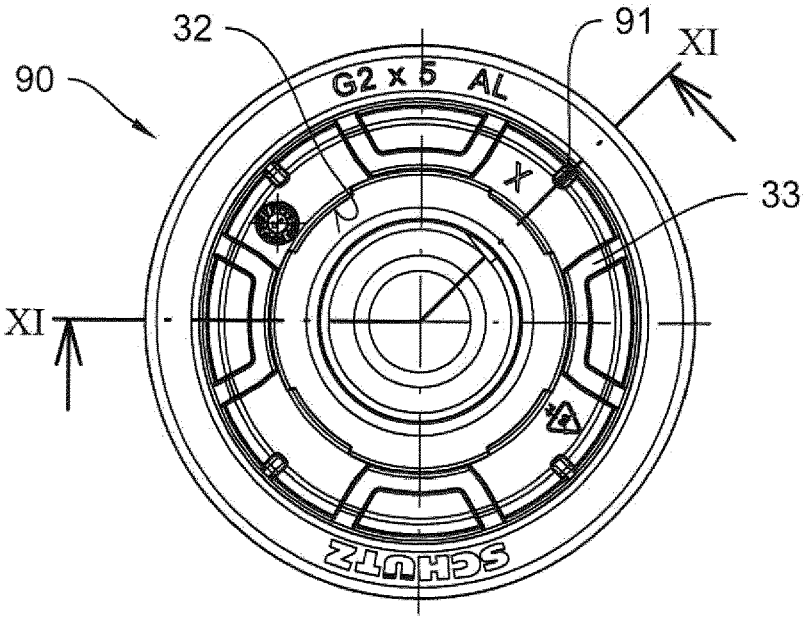
FIG. 10 shows a top view of the bung plug shown in FIG. 9.
Figure 11:
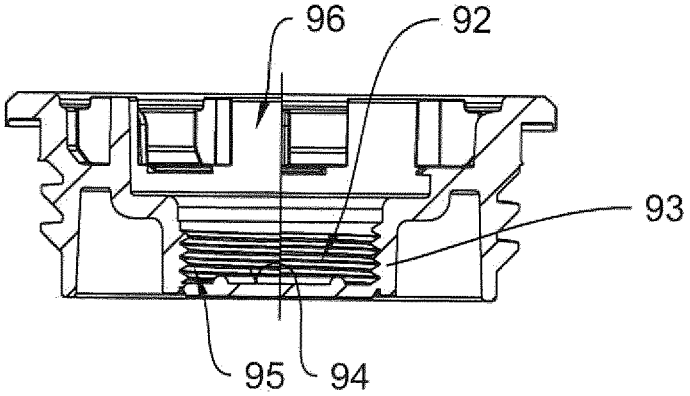
FIG. 11 shows a cross-sectional view of the bung plug shown in FIG. 9 according to cutting line IX-IX in FIG. 10.

In FIGS. 9 to 11, a bung plug 90 is shown in another embodiment which comprises webs 91 protruding radially inward from the inner wall 41 of a plug depression 96 in the gaps 34 as compared to the bung plug 31 described in full detail with reference to FIGS. 2 to 5. Furthermore, the bung plug 90 is provided with an internal thread 95 above a bottom floor 94 on a sleeve-shaped shoulder 93 connecting to the peripheral edge 43 of a depression bottom 92 as compared to the bung plug 31.

The invention claimed is:

1. A bung plug closure (30) for a bung container having a bung plug (31, 60, 90) for being arranged in a bung neck of the bung container and having a seal cap (11) for sealing a plug depression (51, 64, 96) formed in the bung plug (31, 60, 90), said plug depression (51, 64, 96) comprising a receiving area for receiving a resilient engagement body (20) formed on the seal cap (11), and said bung plug (31, 60, 90) comprising tool engagements (33), which are arranged at an inner wall (41) of the plug depression (51, 64, 96) and which are distanced to each other via gaps (34) and which delimit the receiving area using inner surfaces (37) which at least in sections form guide surfaces for axially guiding an annular locking protrusion (21) of the engagement body (20) when inserting the engagement body (20) into the plug depression (51, 64, 96), counter-locking elements (32) for locking the annular locking protrusion (21) of the engagement body (20) to the bung plug (31, 60, 90) being provided in the plug depression (51, 64, 90), said counter-locking elements (32) radially inward protruding over the annular locking protrusion (21) of the engagement body (20) after locking, characterized in that the counter-locking elements (32) are arranged in the area of the gaps (34) above an annular frame (35, 61), which is formed outside of the gaps (34) via lower sections (36) of the inner surfaces (37), in such a manner that the locking protrusion (21) is received by the annular frame (35, 61).

2. The bung plug closure according to claim 1, characterized in that the annular frame (35, 61) is delimited downward via a peripheral edge (43) of a depression bottom (44, 92) of the plug depression (51, 64, 96).

3. The bung plug closure according to claim 2, characterized in that the peripheral edge (43) of the depression bottom (44, 92) is elevated for forming a bottom indentation (45) with respect to a bottom floor (46, 94).

4. The bung plug closure according to claim 1, characterized in that the annular frame (35) is delimited upward in the area of the gaps (34) via platform surfaces (40), which extend radially outward, in such a manner that the annular frame (35) is formed in the area of the gaps (34) via front surfaces (38) of supporting platforms (39) formed in the gaps (34).

5. The bung plug closure according to claim 4, characterized in that the platform surfaces (40) of the supporting platforms (39) formed in the area of the gaps (34) are formed by a supporting collar (42) extending radially inward and formed on an inner wall (41) of the bung plug (31).

6. The bung plug closure according to claim 1, characterized in that the annular frame (61) is formed in the area of the gaps (34) via webs (62) which connect the tool engagements (33), material recesses (63) being provided between the webs (62) and the inner wall (41) of the plug depression (64).

7. The bung plug closure according to claim 1, characterized in that webs (91) protruding radially inward are formed in the gaps (34) of the inner wall (41) of the plug depression (96).

8. The bung plug closure according to claim 3, characterized in that in the area of the gaps (34), the bung plug (31, 60, 90) comprises a plug cross section (48) sloping radially inward starting from the counter-locking element (32) towards the frame (35, 61), the peripheral edge (43) of the depression bottom (44, 92) and a sleeve-shaped shoulder (47, 93), which is formed in the transition to the bottom floor (46, 94), in a step-like manner.

9. The bung plug closure, in particular according to claim 1, characterized in that the tool engagements (33) comprise an edge elevation (49) at the upper edge of the inner surfaces (37) in such a manner that an indentation (52) is formed between the edge elevation (49) and an upper peripheral edge (50) of the inner wall (41) of the plug depression (51).

* * * * *